US010452022B2

(12) United States Patent
Fukaya et al.

(10) Patent No.: US 10,452,022 B2
(45) **Date of Patent: *Oct. 22, 2019**

(54) PROCESS CARTRIDGE

(71) Applicant: Brother Kogyo Kabushiki Kaisha, Nagoya-shi, Aichi-ken (JP)

(72) Inventors: Atsushi Fukaya, Toyohashi (JP); Aya Adachi, Nagoya (JP); Hideshi Nishiyama, Owariasahi (JP); Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/200,818

(22) Filed: Nov. 27, 2018

(65) Prior Publication Data

US 2019/0094797 A1 Mar. 28, 2019

Related U.S. Application Data

(63) Continuation of application No. 15/473,723, filed on Mar. 30, 2017, now Pat. No. 10,168,663.

(30) Foreign Application Priority Data

Mar. 31, 2016 (JP) ..... 2016-073469

(51) Int. Cl.

| | |
|---|---|
| ***G03G 21/18*** | (2006.01) |
| ***G03G 21/12*** | (2006.01) |
| ***G03G 21/10*** | (2006.01) |

(52) U.S. Cl.

CPC ..... *G03G 21/1814* (2013.01); *G03G 21/12* (2013.01); *G03G 21/1817* (2013.01); *G03G 21/1821* (2013.01); *G03G 21/105* (2013.01)

(58) Field of Classification Search

CPC ..... G03G 21/1814; G03G 21/105; G03G 2221/1624

See application file for complete search history.

(56) References Cited

U.S. PATENT DOCUMENTS

| | | | | |
|---|---|---|---|---|
| 5,289,241 | A | 2/1994 | Sugiyama et al. | |
| 10,168,663 | B2 * | 1/2019 | Fukaya | G03G 21/1814 |
| 2002/0141779 | A1 | 10/2002 | Okabe et al. | |
| 2003/0039484 | A1 | 2/2003 | Naito et al. | |
| 2013/0164032 | A1 | 6/2013 | Sato et al. | |

FOREIGN PATENT DOCUMENTS

| | | | |
|---|---|---|---|
| JP | 2011-118040 | A | 6/2011 |

* cited by examiner

*Primary Examiner* — Sandra Brase
(74) *Attorney, Agent, or Firm* — Banner & Witcoff, Ltd.

(57) ABSTRACT

A process cartridge, comprising: a drum cartridge; and a waste toner case, the drum cartridge comprising: a development roller; a first side wall to support one end of a shaft of the development roller; a second wall to support the other end of the shaft; a photosensitive drum; a cleaner; and a conveying tube, the conveying tube comprising: a first part disposed on an opposite side of the second side wall with respect to the first side wall in an axis direction, the first part being connected to the cleaner; a second part disposed closer to the second side wall relative to the first part and connected to the waste toner case; and a third part connecting the first part with the second part, wherein a direction in which the waste toner case is attached is equal to a direction in which the second part extends.

13 Claims, 12 Drawing Sheets

PROCESS CARTRIDGE

CROSS-REFERENCE TO RELATED APPLICATION

This application is a continuation of U.S. patent application Ser. No. 15/473,723 on Mar. 30, 2017, which claims priority under 35 U.S.C. § 119 from Japanese Patent Application No. 2016-073469, filed on Mar. 31, 2016. The entire subject matter of the applications are incorporated herein by reference.

BACKGROUND

Technical Field

Aspects of the present disclosure relate to a process cartridge.

Related Art

A process cartridge configured to be detachably attachable to an image forming apparatus is known. In the process cartridge, a development roller and a photosensitive drum which receives toner from the development roller are provided. In such a process cartridge, it is desirable to remove toner remaining on a circumferential surface of the photosensitive drum after an image has been transferred to a sheet.

For example, the process cartridge includes a cleaner for removing toner from the circumferential surface of the photosensitive drum, a waste toner case for storing the toner removed by the cleaner, and a conveying tube which connects the cleaner with the waste toner case. The waste toner case is disposed on the opposite side of the photosensitive drum with respect to the development roller. The conveying tube is disposed on a side surface of the process cartridge in regard to an axis direction of the development roller. One end of the conveying tube is connected to the cleaner, and the other end of the conveying tube is connected to the waste toner case.

SUMMARY

However, in the above described conventional process cartridge, the conveying tube is disposed on the side surface of the process cartridge, and extends along the side surface of the process cartridge. Therefore, downsizing of the process cartridge in the axis direction is limited.

In consideration of the above, aspects of the present disclosure provide a process cartridge configured to be downsized in regard to an axis direction.

According to an aspect of the present disclosures, there is provided a process cartridge, comprising: a drum cartridge; and a waste toner case configured to be detachably attachable to the drum cartridge. The drum cartridge comprises: a development roller having: a shaft extending in an axis direction; and a roller body provided around the shaft and having a circumferential surface configured to hold ink; a first side wall configured to support one end of the shaft of the development roller; a second wall configured to support the other end of the shaft of the development roller; a photosensitive drum configured to receive the toner from the development roller; a cleaner configured to remove the toner from a circumferential surface of the photosensitive drum; and a conveying tube configured to convey the toner removed by the cleaner. The waste toner case is disposed on an opposite side of the photosensitive drum with respect to the development roller and is configured to store the toner removed by the cleaner. The conveying tube comprises: a first part disposed on an opposite side of the second side wall with respect to the first side wall in the axis direction, the first part being connected to the cleaner; a second part disposed closer to the second side wall relative to the first part, the second part being connected to the waste toner case; and a third part configured to connect the first part with the second part. In this configuration, a direction in which the waste toner case is attached to or detached from the drum cartridge is equal to a direction in which the second part of the conveying tube extends.

BRIEF DESCRIPTION OF THE ACCOMPANYING DRAWINGS

DETAILED DESCRIPTION

First Illustrative Embodiment (1. Overall Configuration of Image Forming Apparatus)

Figure 1:
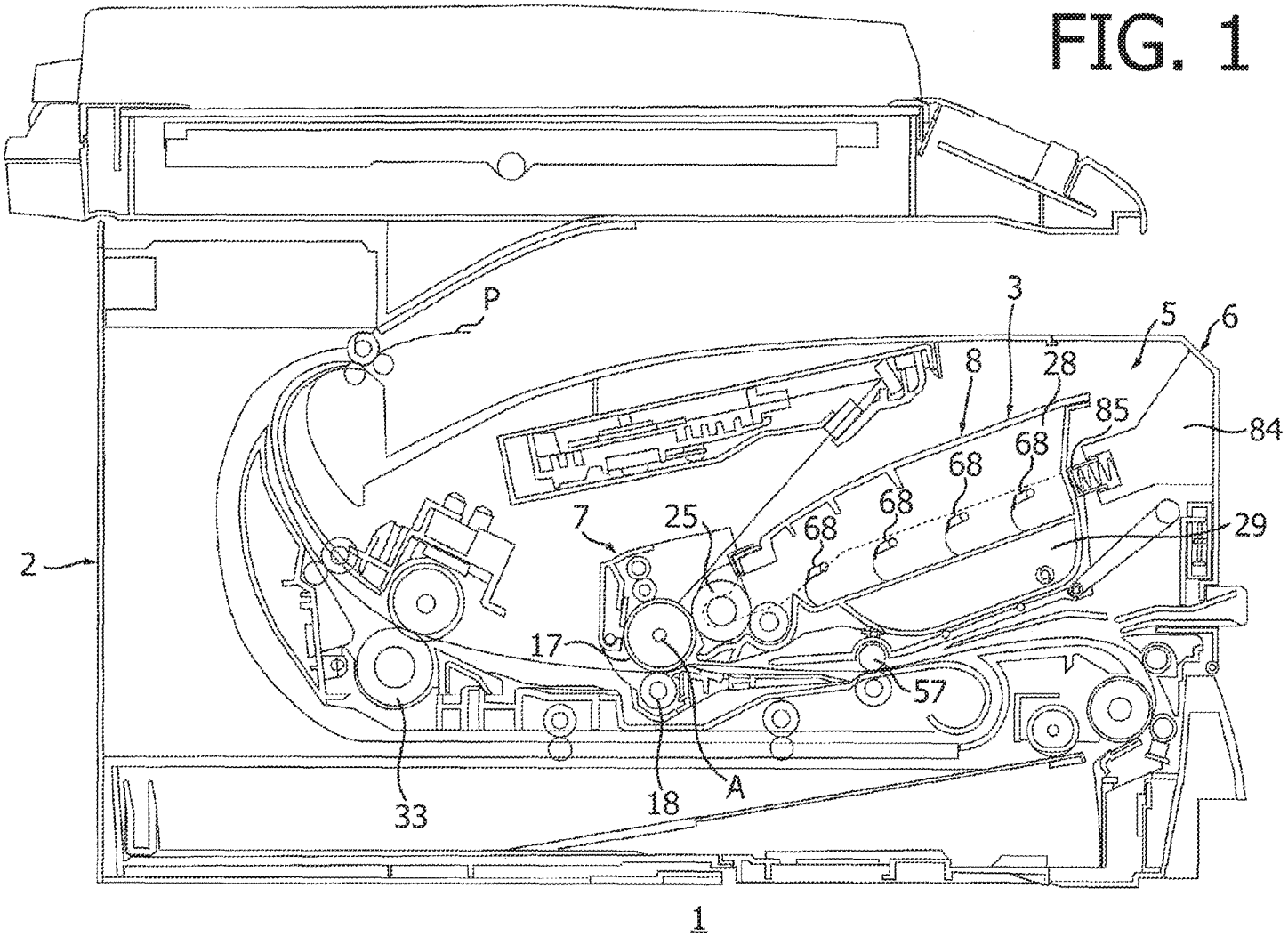
FIG. 1 is a central cross sectional view of an image forming apparatus including a process cartridge according to a first illustrative embodiment.

As shown in FIG. 1, an image forming apparatus 1 includes a main body 2, a process cartridge 3 which is detachably attachable to the main body 2, and a fixing device 33.

(1.1 Main Body 2)

The main body 2 includes an opening 5 and a cover 6.

In a state where the process cartridge 3 is attached to the main body 2, the opening 5 is disposed on the opposite side of the fixing device 33 with respect to the process cartridge 3 in an attaching/detaching direction in which the process cartridge 3 is attached to or detached from the main body 2.

Figure 8:
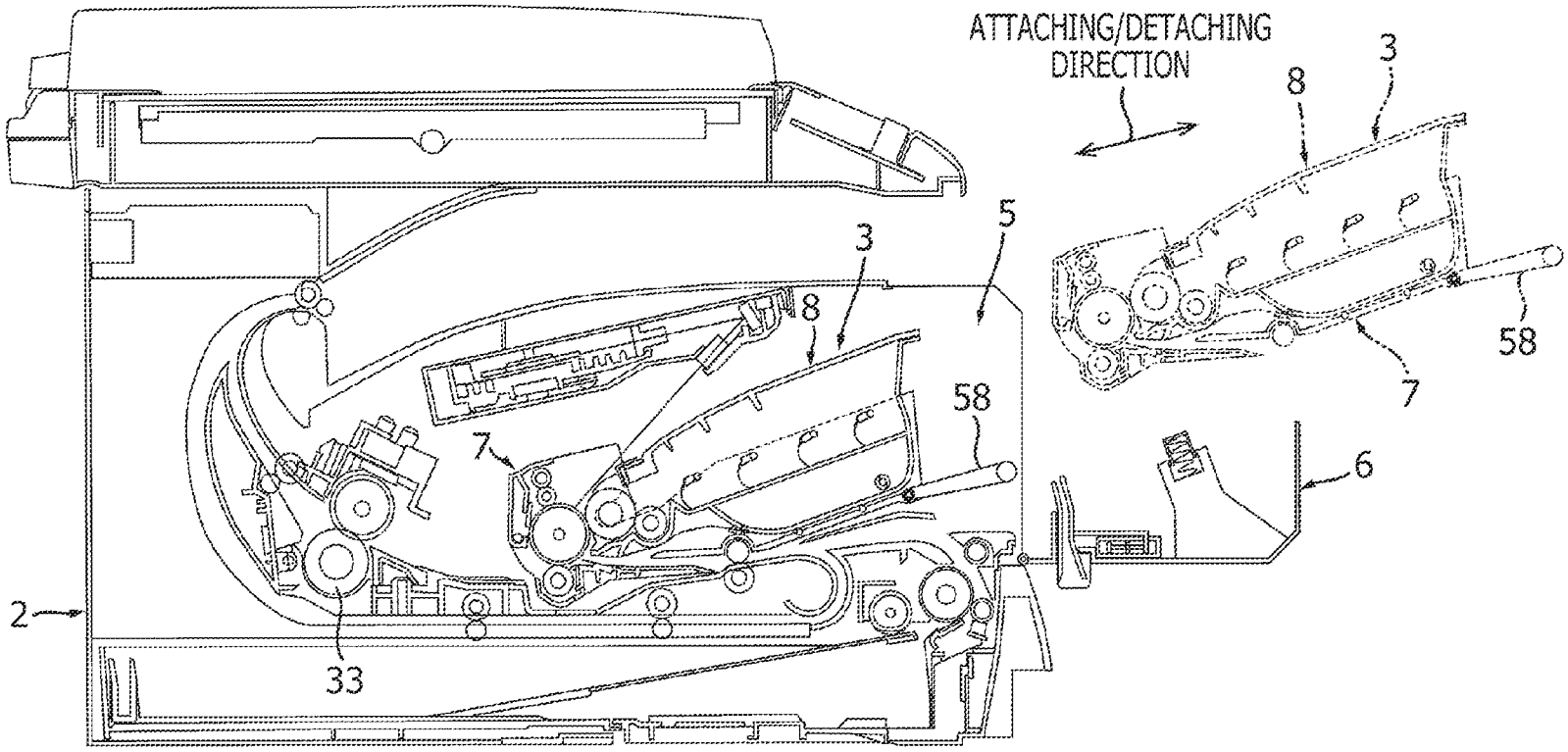
FIG. 8 is an explanatory illustration showing attaching and detaching of the process cartridge with respect to a main body of the image forming apparatus.

The cover 6 is movable between a closing position (see FIG. 1) where the cover 6 closes the opening 5 and an opening position where the cover 6 releases the opening 5 (see FIG. 8).

(1.2 Process Cartridge 3)

The process cartridge 3 is detachably attachable to the main body 2 through the opening 5. The process cartridge 3 includes a drum cartridge 7 and a development cartridge 8.

(1.2.1 Drum Cartridge 7)

The drum cartridge 7 includes a photosensitive drum 17 and a transfer roller 18.

The drum cartridge 17 is rotatable about a rotation axis A.

The transfer roller 18 is in contact with the photosensitive drum 17. The transfer roller 18 transfers a toner image held on the photosensitive drum 17 to a sheet P.

(1.2.2 Development Cartridge 8)

The development cartridge 8 is detachably attachable to the drum cartridge 7. In a state where the process cartridge 3 is attached to the main body 2, the development cartridge 8 is disposed on the opposite side of the fixing device 33 with respect to the photosensitive drum 17. It should be noted that the process cartridge 3 is detachably attachable to the main body 2 through the opening 5 in the attaching/detaching direction of the development cartridge 8 with respect to the drum cartridge 7.

The development cartridge 8 includes a toner storing part 28, a plurality of agitators 68, and a development roller 25.

The toner storing part 28 stores toner. The toner storing part 28 is formed to extend, in the attaching/detaching direction, toward the opposite side of the photosensitive drum 17 with respect to the development roller 25.

In the toner storing part 28, the plurality of agitators 68 are disposed to be spaced with respect to each other along an extending direction of the toner storing part 28. The agitator 68 agitates the toner in the toner storing part 28.

The development roller 25 is in contact with the photosensitive drum 17. The development roller 25 supplies the toner in the toner storing part 25 to the photosensitive drum 17.

(1.3 Fixing Device 33)

In the state where the process cartridge 3 is attached to the main body 2, the fixing device 33 is disposed on the opposite side of the cover 6 with respect to the process cartridge 3 in the attaching/detaching direction. The fixing device 33 makes the toner image, which has transferred to the sheet P, fixed on the sheet P.

(2. Details about Development Cartridge 8)

(2.1 Toner Storing Part 28)

Figure 2A:
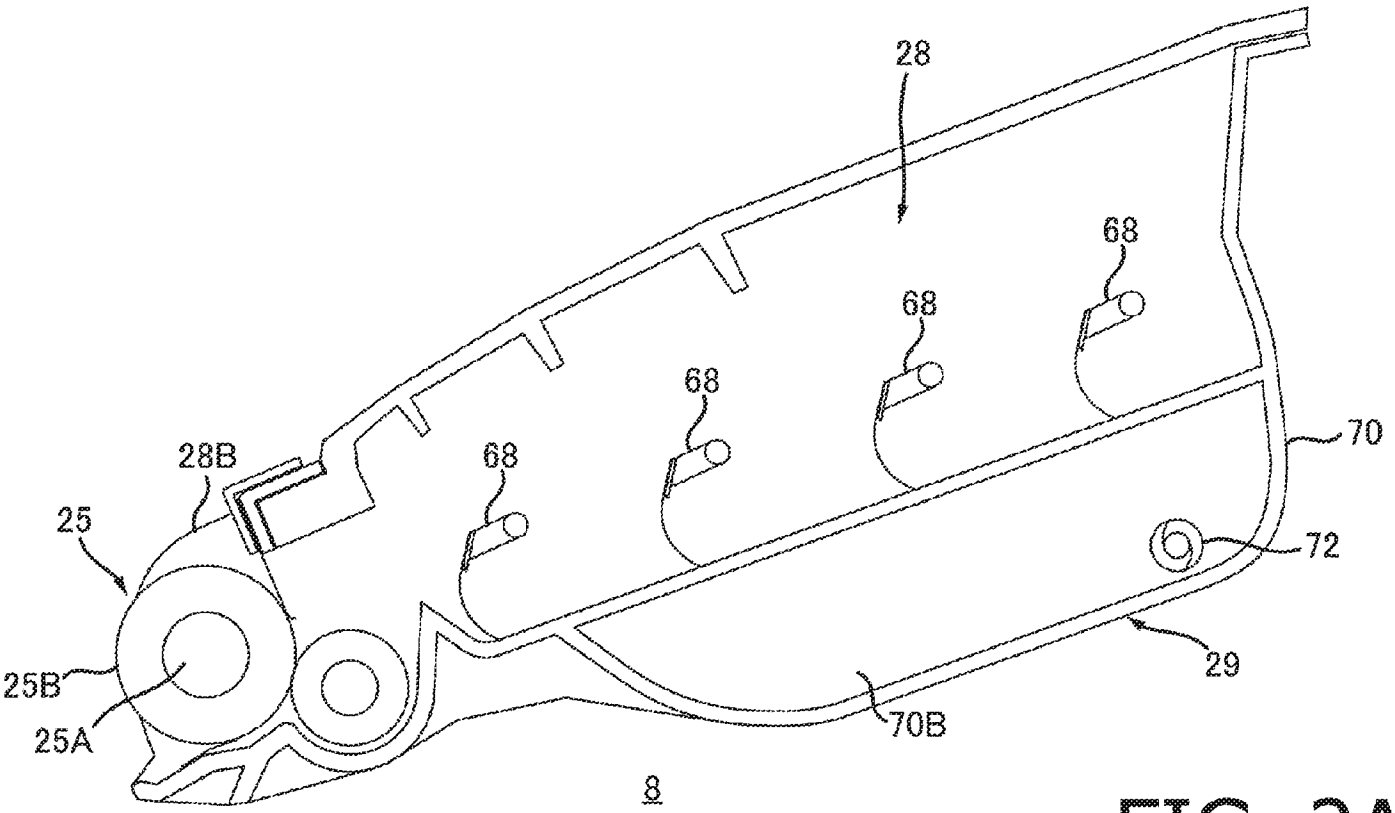
FIG. 2A is a central cross sectional view of a development cartridge shown in FIG. 1.
Figure 3:
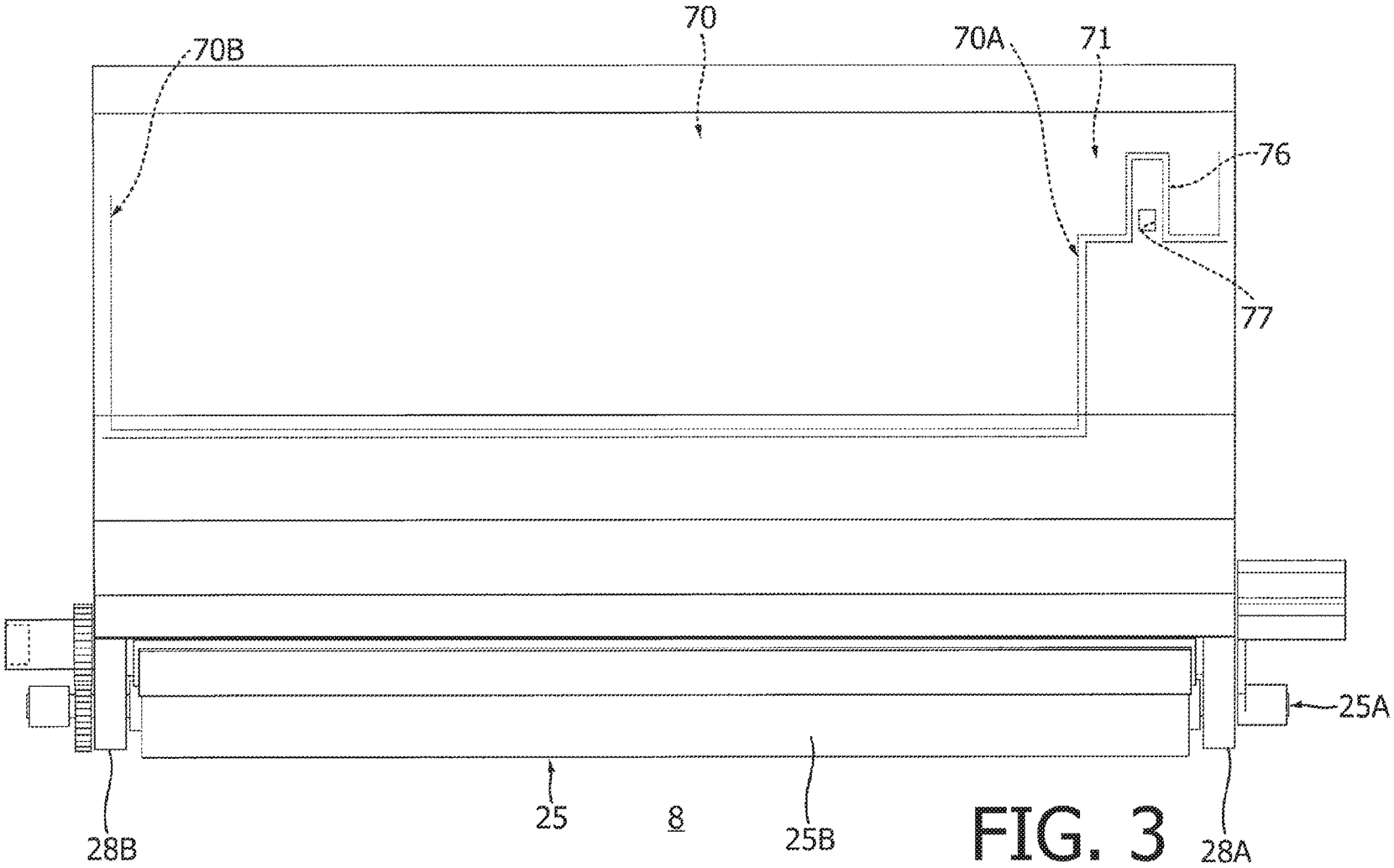
FIG. 3 is a plan view of the development cartridge shown in FIGS. 2A and 2B.

As shown in FIGS. 2A and 3, the toner storing part 28 includes a first side wall 28A and a second side wall 28B.

The first side wall 28A and the second side wall 28B are disposed to be spaced in an axis direction of the photosensitive drum 17. In the axis direction, the first side wall 28A is disposed at an end of the toner storing part 28, and the second side wall 28B is disposed at the other end of the toner storing part 28.

(2.2 Development Roller 25)

The development roller 25 is formed to extend in the axis direction. A part of the development roller 25 is exposed from the development cartridge 8. The development roller 25 includes a shaft 25A and a roller body 25B.

The shaft 25A is formed to extend in the axis direction. The shaft 25A has a cylindrical shape. An end of the shaft 25A is supported by the first side wall 28A, and is projected outward with respect to the first side wall 28A in the axis direction. The other end of the shaft 25A is supported by the second side wall 28B, and is projected outward with respect to the second side wall 28B in the axis direction.

The roller body 25B is provided around the shaft 25A. The roller body 25B includes a circumferential surface configured to hold toner. The roller body 25B is rotatable together with the shaft 25A. The roller body 25B is disposed between the first side wall 28A and the second side wall 28B of the toner storing part 28. The roller body 25B is in contact with the circumferential surface of the photosensitive drum 17. Is should be noted that the roller body 25B may be disposed not to in contact with the circumferential surface of the photosensitive drum 17, and may be configured to supply toner to the circumferential surface of the photosensitive drum 17 by a jumping phenomenon.

(3. Details about Waste Toner Case 29)

Figure 2B:
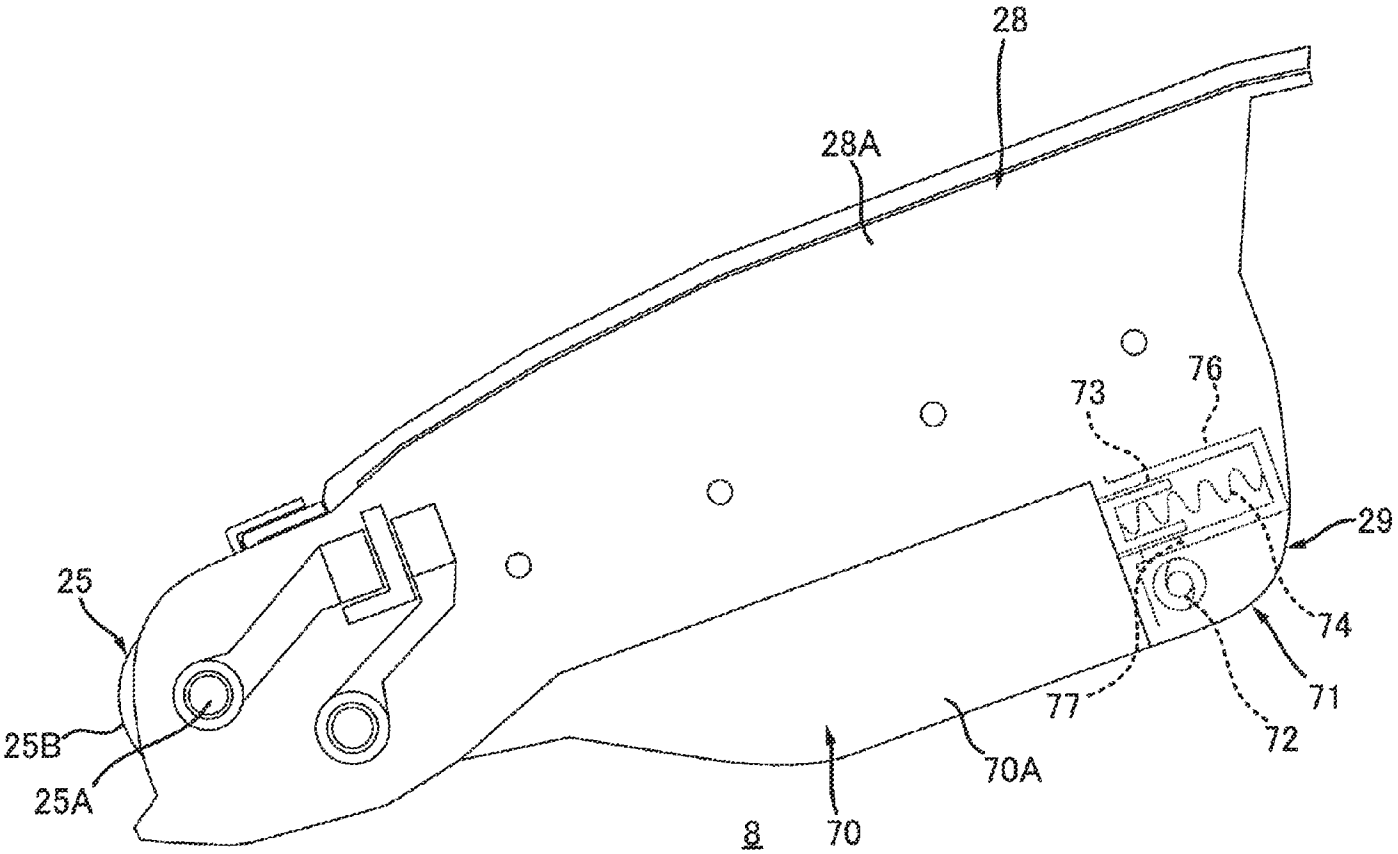
FIG. 2B is a side view of the development cartridge shown in FIG. 1.

As shown in FIGS. 2A and 2B, the development cartridge 8 further includes a waste toner case 29. Since the development cartridge 8 is detachably attachable to the drum cartridge 7, the waste tone case 29 is also detachably attachable to the drum cartridge 7.

The waste toner case 29 stores the toner removed from the photosensitive drum 17. The waste toner case 29 is disposed to be closer to the toner storing part 28 in the attaching/detaching direction relative to the development roller 25. The waste toner case 29 is arranged side by side with the toner storing part 28 in an intersecting direction intersecting with the attaching/detaching direction. Preferably, the waste toner case 29 is disposed at a lower position with respect to the toner storing case 29. The toner storing case 29 is integrally formed with the toner storing part 28.

As shown in FIG. 1, in the state where the development cartridge 8 is attached to the drum cartridge 7, the waste toner case 29 is disposed on the opposite side of the photosensitive drum 17 with respect to the development roller 25.

The capacity of the waste toner case 29 is, for example, 5% or more of the capacity of the toner storing part 28, or preferably 10% or more of the capacity of the toner storing part 28, and is, for example, 50% or less of the toner storing part 28, or preferably 30% or less of the capacity of the toner storing part 28. Consequently, it becomes possible to approximately calculate the upper limit of the capacity of the waste toner case 29.

As shown in FIGS. 2A and 2B, the waste toner case 29 includes a body unit 70, a projecting part 71, an auger screw 72, a shutter 73 and a spring 74.

(3.2 Body Unit 70)

As shown in FIGS. 2A and 3, the body unit 70 is provided between the first side wall 28A and the second side wall 28B of the toner storing case 28 in the axis direction. As shown in FIGS. 2A and 2B, the body unit 70 is disposed to overlap with the toner storing case 28 in the attaching/detaching direction. The waste toner case 29 includes a third side wall 70A and a fourth side wall 70B.

As shown in FIGS. 2B and 3, the third side wall 70A is disposed between the first side wall 28A and the second side wall 28B in the axis direction. In other words, the third side wall 70A is disposed at a position recessed in the axis direction with respect to the first side wall 28A.

The fourth side wall 70B is flush with the second side wall 28B.

(3.2 Projecting Part 71)

The projecting part 71 is disposed at one end of the waste toner case 29 farther from the development roller 25 relative to the other end of the waste toner case 29 disposed close to the development roller 25. As shown in FIGS. 2B and 3, the projecting part 71 projects from the body unit 70 in the axis direction. That is, the projecting part 71 is disposed on the opposite side of the fourth side wall 70B with respect to the third side wall 70A of the body unit 70 in the axis direction. The projecting part 71 communicates with the body unit 70. An end of the projecting part 71 farthest from the body unit 70 is flush with the first side wall 28A. The projecting part 71 includes a first end surface and a second end face disposed on the opposite side of the first end surface in the attaching/detaching direction. The first end surface is disposed closer to the development roller 25 relative to the second end surface. The projecting part 71 includes a receiving cylinder 76.

The receiving cylinder 76 is formed to extend from the first end surface to the second end surface of the projecting part 71 in the attaching/detaching direction. The receiving cylinder 76 has a cylindrical shape. The receiving cylinder 76 has one end, and the other end disposed on the opposite side of the one end in the attaching/detaching direction. The one end of the receiving cylinder 76 is opened. The other end of the receiving cylinder 76 is closed. The receiving cylinder 76 includes a receiving port 77.

The receiving port 77 is a port through which the waste toner case 29 receives the toner. As shown in FIG. 2B, the receiving port 77 is formed in the circumferential surface of the receiving cylinder 76 at the opposite position of the toner storing case 28 with respect to the shutter 73. The receiving port 77 penetrates through the circumferential surface of the receiving cylinder 76. Preferably, the receiving port 77 penetrates through a lower edge part of the circumferential surface of the receiving cylinder 76. The receiving port 77 is formed to extend in the attaching/detaching direction of the development cartridge 8 with respect to the drum cartridge 7.

(3.3 Auger Screw 72)

As shown in FIGS. 2A and 2B, the auger screw 72 is disposed in the inside of the body unit 70 and the projecting part 71. The auger screw 72 is formed to extend in the axis direction. In the axis direction, one end of the auger screw 72 is rotatably supported by the body unit 70. The other end of the auger screw 72 is rotatably supported by the projecting part 71. The other end of the auger screw 72 faces the receiving port 77 in the intersecting direction. The auger screw 72 conveys, from the projecting part 77 to the body unit 70, the toner flowed into the projecting part 71 from the receiving port 77.

(3.4 Shutter 73 and Spring 74)

As shown in FIG. 2B, the shutter 73 is disposed in the receiving cylinder 76. The shutter 73 is movable between a closing position (see FIG. 2B) where the shutter 73 closes the receiving port 77 and an opening position where the shutter 73 releases the receiving port 77.

The spring 74 is disposed between the shutter 73 and an inner surface of the other end of the receiving cylinder 76. The spring 74 constantly presses the shutter 73 such that the shutter 73 is disposed at the closing position.

(4. Details about Drum Cartridge 7)

(4.1 Fifth Side Wall 41, Sixth Side Wall 42 and Connecting Wall 43)

Figure 4:
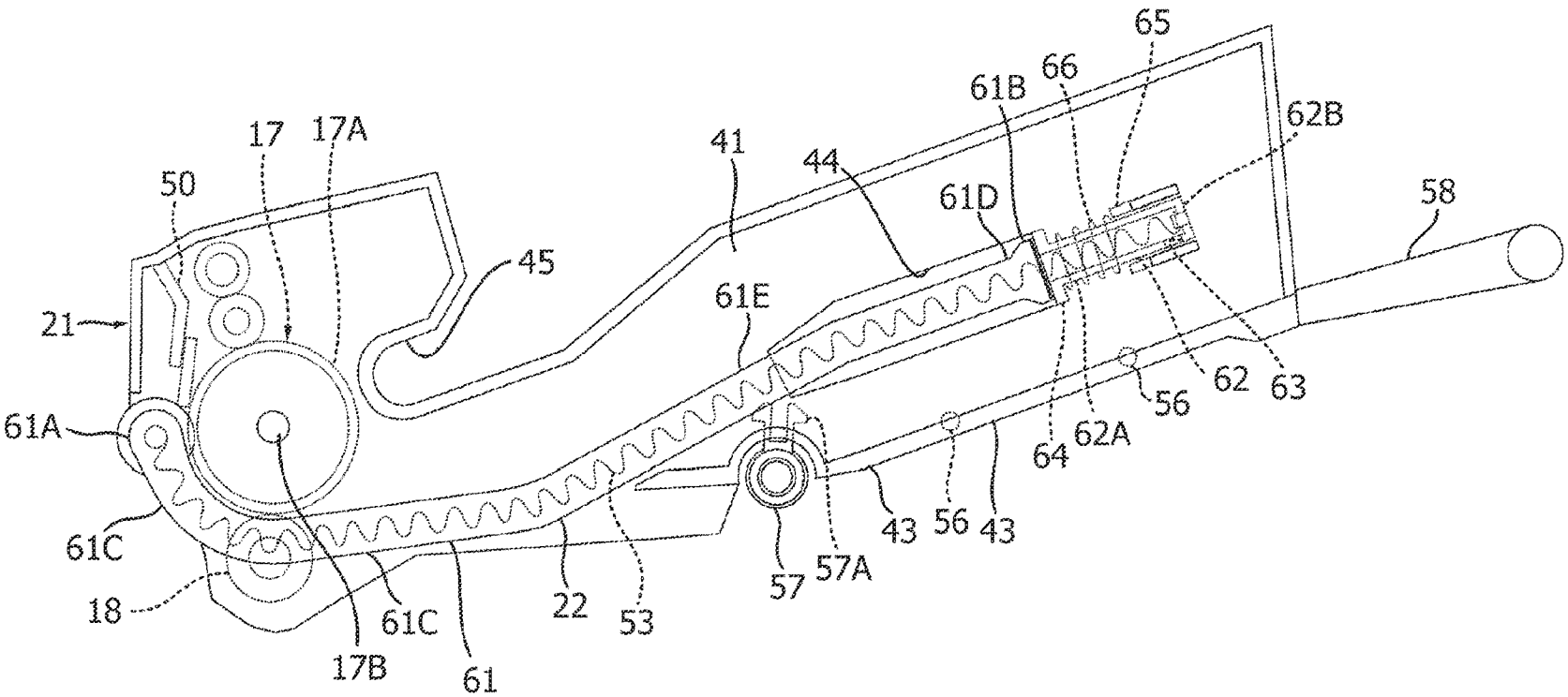
FIG. 4 is a side view of a drum cartridge shown in FIG. 1.
Figure 5:
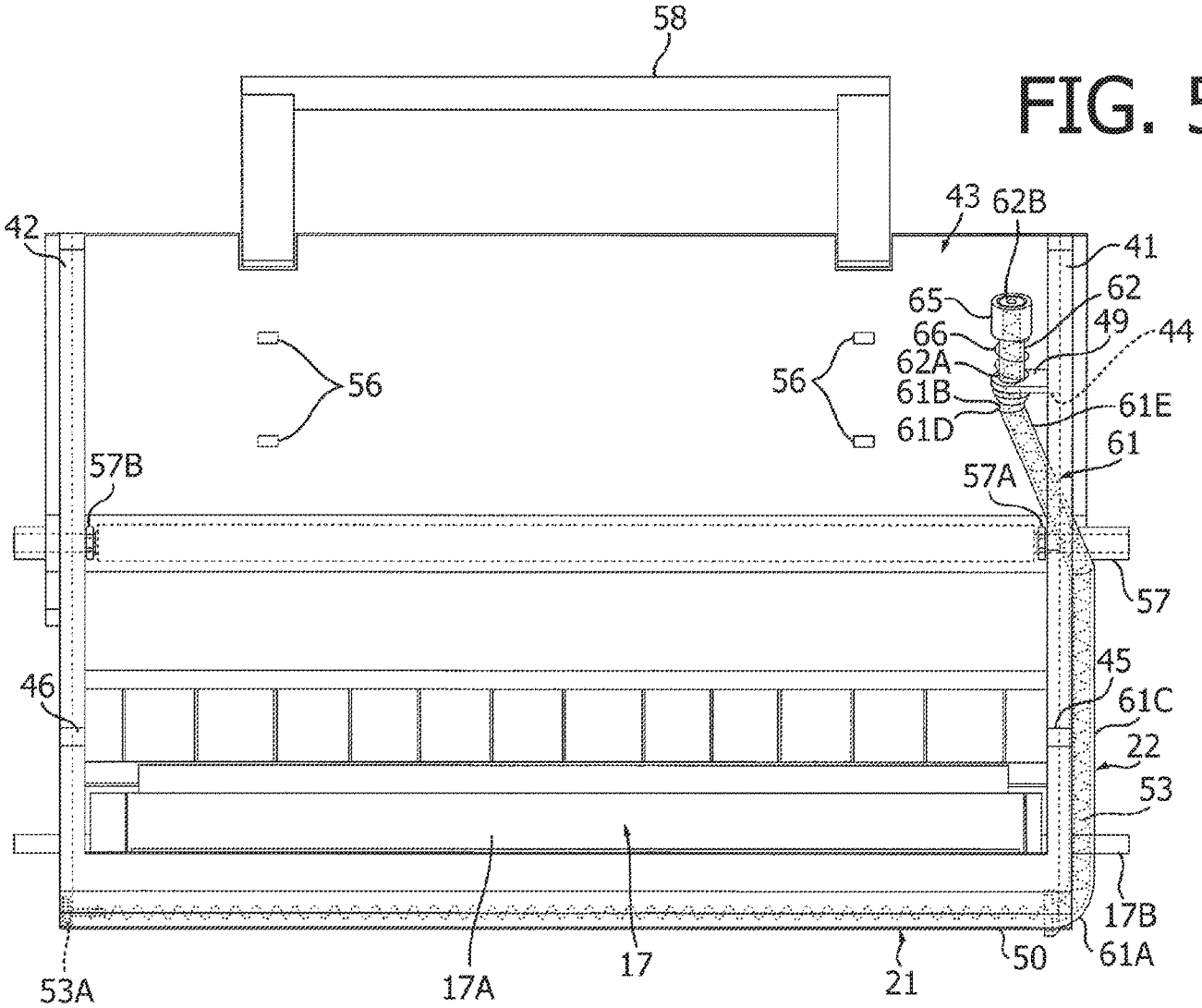
FIG. 5 is a plan view of the drum cartridge shown in FIG. 4.

As shown in FIGS. 4 and 5, the drum cartridge 7 includes a fifth side wall 41, a sixth side wall 42 and a connecting wall 43.

(4.1.1 Fifth Side Wall 41 and Sixth Side Wall 42)

The fifth sided wall 41 and the sixth side wall 42 are disposed to be spaced with respect to each other in the axis direction of the photosensitive drum 17. Each of the fifth side wall 41 and the sixth side wall 42 is formed to extend in the attaching/detaching direction. Each of the fifth side wall 41 and the sixth side wall 42 has a plate-like shape. The fifth side wall 41 supports one end of the photosensitive drum 17 in the axis direction. The sixth side wall 42 supports the other end of the photosensitive drum 17 in the axis direction.

The fifth side wall 41 has a first development guide 45, a hole 44 and a fixing part 49.

The first development guide 45 is disposed on the opposite side of a cleaner 21 described later with respect to the photosensitive drum 17 in the attaching/detaching direction. The first development guide 45 is formed to extend in the attaching/detaching direction. The first development guide 45 is formed to be opened toward the opposite side of the cleaner 21 with respect to the photosensitive drum 17. The first development guide 45 guides attaching and detaching of the development cartridge 8.

The hole 44 is disposed on the opposite side of the photosensitive drum 17 with respect to the first development guide 45. The hole 44 is formed to penetrate through the fifth side wall 41 in the axis direction. The hole 44 extends in the attaching/detaching direction. In the attaching/detaching direction, the hole 44 has one end closer to the photosensitive drum 17 and the other end which is opposed to the one end and farther from the photosensitive drum 17. The hole 44 receives a third part 61E of a conveying tube 22 which is described later.

The fixing part 49 is disposed at the other end of the hole 44. The fixing part 49 is formed to extend from the fifth side wall 41 toward the sixth side wall 42. The fixing part 49 has a plate-like shape. The fixing part 49 fixes a second conveying tube 62 of the conveying tube 22.

Figure 6:
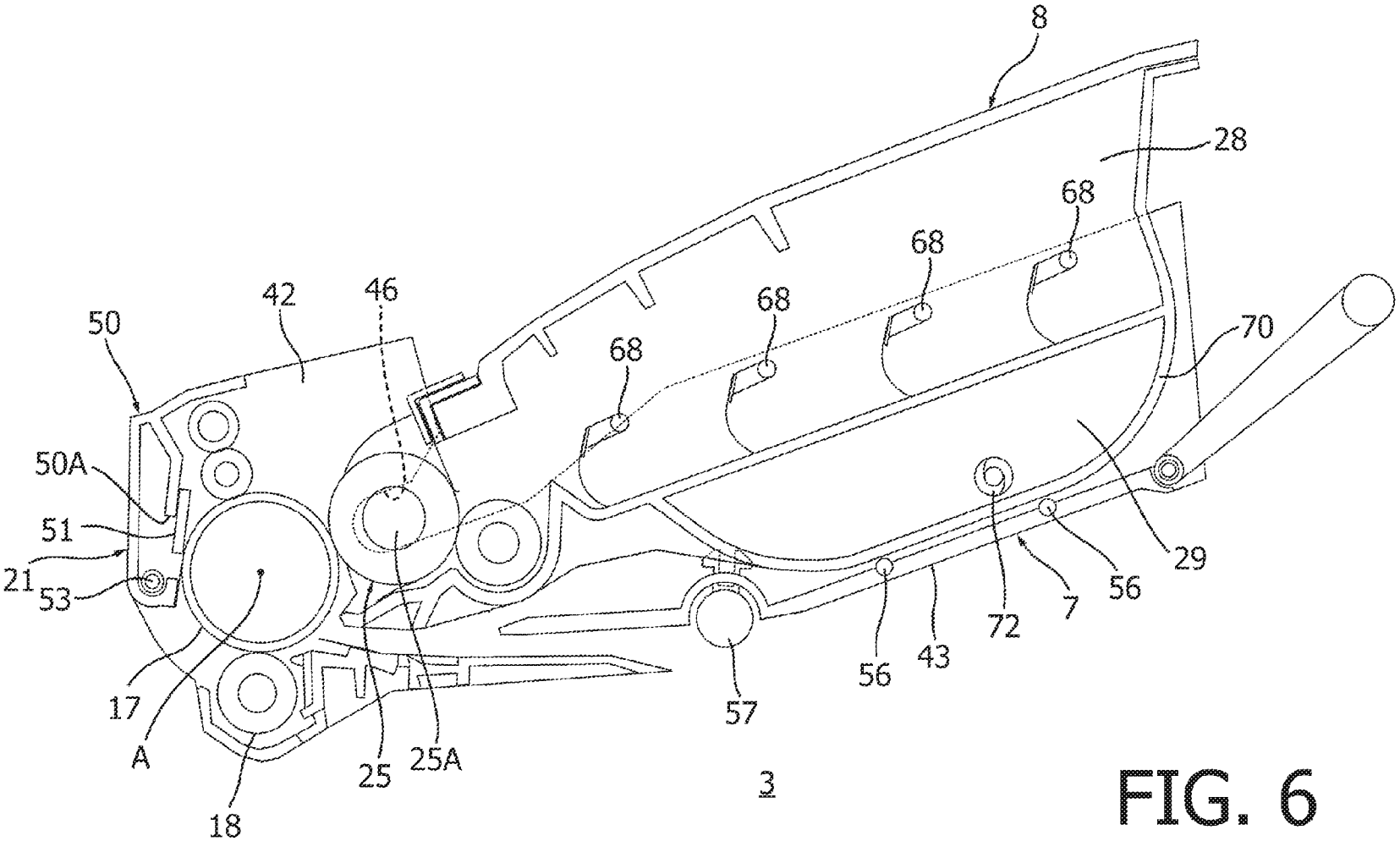
FIG. 6 is a central cross sectional view of the process cartridge shown in FIG. 1.

As shown in FIGS. 5 and 6, the sixth side wall 42 includes a second development guide 46.

The second development guide 46 has the same shape as that of the first development guide 45.

Figure 7:
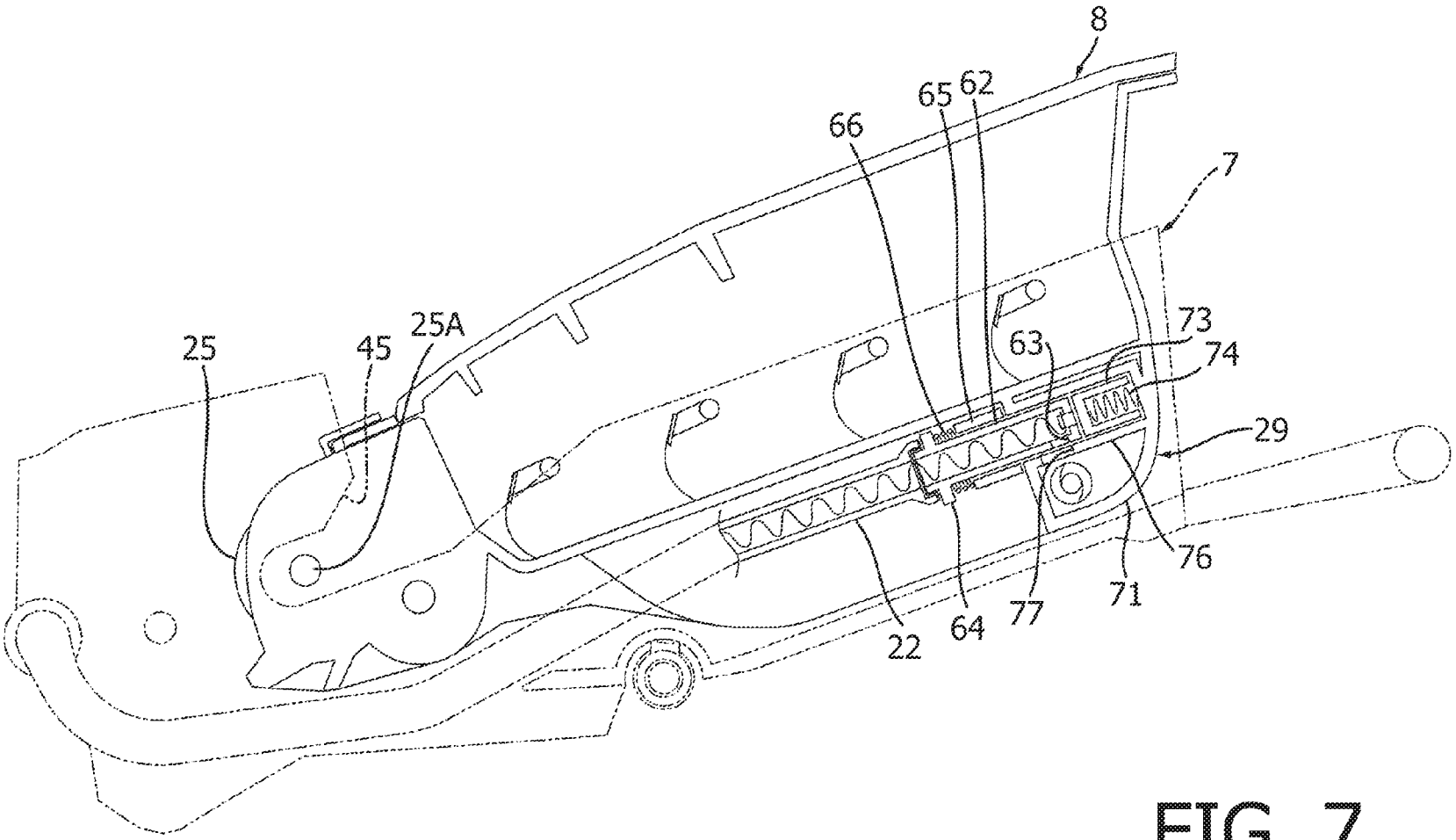
FIG. 7 is a side cross section of the process cartridge shown in FIG. 6, wherein the drum cartridge is shown by an imaginary line.

As shown in FIG. 7, in the state where the development cartridge 8 is attached to the drum cartridge 7, the first development guide 45 receives one end of the shaft 25A of the development roller 25. The first development guide 45 guides the development roller 25 when the development cartridge 8 is attached to or detached from the drum cartridge 7.

As shown in FIG. 6, in the state where the development cartridge 8 is attached to the drum cartridge 7, the second development guide 46 receives the other end of the shaft 25A of the development roller 25. The second development guide 46 guides the development roller 25 when the development cartridge 8 is attached to or detached from the drum cartridge 7.

(4.1.2 Connecting Wall 43)

As shown in FIGS. 4 and 5, the connecting wall 43 is disposed between the fifth side wall 41 and the sixth side wall 42. The connection wall 43 is formed to extend in the attaching/detaching direction. The connecting wall 43 includes a plurality of rollers 56.

The plurality of rollers 56 are disposed to be spaced with respect to each other. The rollers 56 are provided to project from the connecting wall 43. The rollers 56 are rotatably supported by the connecting wall 43. As shown in FIG. 6, in the state where the development cartridge 8 is attached to the drum cartridge 7, the rollers 56 support the waste toner case 29. The rollers 56 slide on the waste toner case 29. As a result, the development cartridge 8 including the waste toner case 29 is able to smoothly move with respect to the drum cartridge 7.

(4.2 Photosensitive Drum 17)

The photosensitive drum 17 receives the toner from the development roller 25. In the state where the development cartridge 8 is attached to the drum cartridge 7, the photosensitive drum 17 is disposed between the cleaner 21 and the development cartridge 8 in the attaching/detaching direction. As shown in FIGS. 4 and 5, the photosensitive drum 17 includes a cylindrical part 17A and a drum shaft 17B.

The cylindrical part 17A extends in the axis direction. The cylindrical part 17A is disposed between the fifth side wall 41 and the sixth side wall 42 in the axis direction.

The drum shaft 17B extends in the axis direction. In regard to the axis direction, one end of the drum shaft 17B is rotatably supported by the fifth side wall 41, and the other end of the drum shaft 17B is rotatably supported by the sixth side wall 42.

(4.3 Conveying Roller 57 and Handle 58)

The drum cartridge 7 further includes a conveying roller 57 and a handle 58.

(4.3.1 Conveying Roller 57)

As shown in FIG. 1, the conveying roller 57 is provided to be able to convey the sheet P to a position between the photosensitive drum 17 and the transfer roller 18 while letting the sheet P to pass through rollers provided in the image forming apparatus 1. The conveying roller 57 is disposed on the opposite side of the fixing device 33 with respect to the photosensitive drum 17 in the attaching/detaching direction. As shown in FIG. 6, the conveying roller 57 is disposed between the development roller 25 and the waste toner case 29 in the direction in which the conveying tube 22 extends, i.e., the attaching/detaching direction. As shown in FIGS. 4 and 5, the conveying roller 57 extends in the axis direction. In the axis direction, one end of the conveying roller 57 is supported by the connecting wall 43 via a first holding part 57A. In the axis direction, the one end of the conveying roller 57 projects with respect to the fifth side wall 41. In the axis direction, the other end of the conveying roller 57 is supported by the connection wall 43 via a second holding part 57B. In the axis direction, the other end of the conveying roller 57 projects with respect to the sixth side wall 42.

(4.3.2 Handle 58)

The handle 58 is disposed on the opposite side of the photosensitive drum 17 with respect to the conveying roller 57 in the attaching/detaching direction. In the attaching/detaching direction, the handle 58 is disposed on the opposite side of the conveying roller 57 with respect to the plurality of rollers 56. The handle 58 is supported by the connecting wall 43 to be rotatable relative to the connecting wall 43.

(5. Configuration for Conveying Toner in Drum Cartridge)

(5.1 Cleaner 21)

The drum cartridge 7 further includes the cleaner 21.

The cleaner 21 removes toner remaining on the circumferential surface of the photosensitive drum 17. As shown in FIG. 6, in the state where the development cartridge 8 is attached to the drum cartridge 7, the cleaner 21 is disposed on the opposite side of the development cartridge 8 with respect to the photosensitive drum 17. As shown in FIGS. 5 and 6, the cleaner 21 includes a cleaning frame 50 and a cleaning member 51.

The cleaning frame 50 extends in the axis direction. The cleaning frame 50 has a shape of a hollow cylinder. In the axis direction, one end of the cleaning frame 50 is connected to the fifth side wall 41, and the other end of the cleaning frame 50 is connected to the sixth side wall 42. As shown in FIG. 6, the cleaning frame 50 has an opening 50A.

In the cleaning frame 50, the opening 50A faces the photosensitive drum 17. The opening 50A extends in the axis direction. The opening 50A penetrates through the cleaning frame 50 in the attaching/detaching direction.

The cleaning member 51 has a plate-like shape. The cleaning member 51 is fixed to a periphery of the opening 50A. The cleaning member 51 is in contact with the circumferential surface of the photosensitive drum 17. Specifically, the cleaning member 51 contacts the circumferential surface of the photosensitive drum 17 at a position on a downstream side in the rotating direction of the photosensitive drum 17 with respect to a contacting part of the photosensitive drum 17 and the transfer roller 18.

In the cleaner 21, the cleaning member 51 wipes out the toner which remains on the circumferential surface of the photosensitive drum 17 without being transferred to the sheet P. The toner thus wiped out is received and stored by the cleaning frame 50 via the opening 50A. The toner stored in the cleaning frame 50 is then conveyed to the waste toner case 29 via the conveying tube 22 by letting a conveying member 53 described later rotate.

(5.2 Conveying Tube 22, Conveying Member 23, Shutter 65 and Spring 66)

As shown in FIGS. 4 and 5, the drum cartridge 7 includes the conveying tube 22, the conveying member 53, a shutter 65 and a spring 66.

(5.2.1 Conveying Tube 22)

The conveying tube 22 conveys the toner removed by the cleaner 21. As shown in FIGS. 4 and 7, in the state where the development cartridge 8 is attached to the drum cartridge 7, the conveying tube 22 connects the cleaning frame 50 of the cleaner 21 with the waste toner case 29 of the development cartridge 8. That is, the conveying tube 22 connects the cleaner 21 with the waste toner caser 29. The toner removed from the circumferential surface of the photosensitive drum 17 passes through the inside of the conveying tube 22. As shown in FIGS. 4 and 5, in the axis direction, the conveying tube 22 is supported by the fifth side wall 41. The conveying tube 22 extends in the attaching/detaching direction. In the axis direction, the conveying tube 22 is arranged side by side with the transfer roller 18. The conveying tube 22 includes a first conveying tube 61 and a second conveying tube 62.

The first conveying tube 61 has a cylindrical shape. The first conveying tube 61 extends from the cleaning frame 50 to the other end of the hole 44 in the attaching/detaching direction. Specifically, the first conveying tube 61 has a first end 61A and a second end 61B.

The first end 61A is one end of the first conveying tube 61 disposed closer to the photosensitive drum 17. The first end 61A overlaps with the cleaner 21 in the axis direction. The first end 61A is connected to the fifth side wall 41. The first end 61A is connected to the fifth side wall 41. The first conveying tube 61 communicates with the cleaning frame 50.

The second end 61B is the other end of the conveying tube 61 disposed on the opposite side of the first end 61A in the attaching/detaching direction. The second end 61B is disposed between the fifth side wall 41 and the sixth side wall 42 in the axis direction. Between the first end 61A and the second end 61B, the first conveying tube 61 includes a first part 61C, a second part 61D and the third part 61E.

The first part 61C extends in the attaching/detaching direction. In the attaching/detaching direction, the first part 61C is disposed on the photosensitive drum 17 side with respect to the conveying roller 57. The first part 61C continues to the first end 61A. That is, the first part 61C is connected to the cleaner 21. The first part 61C is disposed closer to the transfer roller 18 relative to the photosensitive drum 17. The first part 61C overlaps with the transfer roller 18 in the attaching/detaching direction. In the axis direction, the first part 61C is disposed on the opposite side of the second side wall 28B with respect to the first side wall 28A. In the axis direction, the second part 61D is disposed closer to the second side wall 28B relative to the first part 61C. The second part 61D is disposed on the opposite side of the fourth side wall 70B with respect to the third side wall 70A. The first part 61C is disposed at a lower position with respect to the first development guide 45. In other words, the first development guide 45 is disposed at an upper position with respect to the first part 61C.

The second part 61D extends in the attaching/detaching direction. In the attaching/detaching direction, the second part 61D is disposed on the opposite side of the photosensitive drum 17 with respect to the conveying roller 57. The second part 61D continues to the second end 61B. In the axis direction, the second part 61D is disposed on the opposite side of the first part 61C with respect to the fifth side wall 41. The second part 61D is disposed between the first holding part 57A and the second holding part 57B in the axis direction.

The third part 61E is disposed between the first part 61C and the second part 61D in the attaching/detaching direction. The third part 61E connects the first part 61C with the second part 61D. The third part 61E is disposed at an upper position with respect to the conveying roller 57. At least a part of the third part 61E is disposed between the conveying roller 57 and the waste toner case 29 in a direction in which the conveying tube 22 extends.

The second conveying tube 62 is insertable and removable with respect to the waste toner case 29 by letting the waste toner case 29 move in the attaching/detaching direction. In the attaching/detaching direction, the second conveying tube 62 extends from the other end of the hole 44 to depart from the photosensitive drum 17. The second conveying tube 62 is connected to the waste toner case 29. Specifically, the second conveying tube 62 includes a first end 62A and a second end 62B. In the axis direction, the second conveying tube 62 is disposed on the opposite side of the first part 61C with respect to the first development guide 45. The second conveying tube 62 includes a ring part 64 and a discharge port 63.

The first end 62A is one end of the second conveying tube 62 disposed closer to the photosensitive drum 17 in the attaching/detaching direction. The first end 62A is connected to the second end 61B of the first conveying tube 61. As a result, the second conveying tube 62 communicates with the first conveying tube 61. Thus, the second conveying tube 62 integrally continues to the first conveying tube 61.

The second end 62B is disposed on the opposite side of the first end 62A in the attaching/detaching direction.

The ring part 64 projects from the circumferential surface of the second conveying tube 62. The ring part 64 extends in a radial direction of the second conveying tube 62. The ring part 64 has a ring shape. By fixing the ring part 64 to the fixing part 49 of the fifth side wall 4, the second conveying tube 62 is supported by the fifth side wall 41.

The discharge port 63 penetrates through the circumferential surface of the second conveying tube 62. Preferably, the discharge port 63 penetrates through the circumferential surface of the lower edge part of the second conveying tube 62. The toner can be discharged through the discharge port 63. The discharge port 63 extends in the attaching/detaching direction of the development cartridge 8 with respect to the drum cartridge 7.

As shown in FIG. 7, in the state where the development cartridge 8 is attached to the drum cartridge 7, the second conveying tube 62 of the conveying tube 22 fits into the receiving cylinder 76 of the projecting part 71 along the attaching/detaching direction. As a result, the conveying tube 22 is connected to the projecting part 71 of the waste toner case 29. At this time, the discharge port 63 of the second conveying tube 62 faces the receiving port 77 of the receiving cylinder 76. The discharge port 63 of the second conveying tube 62 communicates with the receiving port 77 of the receiving cylinder 76. The length of the discharge port 63 in the attaching/detaching direction is larger than the length of the receiving port 77 in the attaching/detaching direction. Therefore, even when the development cartridge 8 swings with respect to the drum cartridge 7, the discharge port 63 overlaps with the receiving port 77.

(5.2.2 Conveying Member 53)

As shown in FIGS. 4 and 5, the conveying member 53 extends in the axis direction in the cleaning frame 50. Further, the conveying member 53 extends in the attaching direction in the conveying tube 22. The conveying member 53 extends in a spiral shape. One end of the conveying member 53 is supported by the sixth side wall 42 of the cleaning frame 50 to be rotatable about the spiral axis as the rotation center. By rotation, the conveying member 53 is able to convey the toner in the cleaning frame 50 and the conveying tube 22. The opposite end (i.e., the other end) of the one end of the conveying member 53 is rotatably supported by the second end 62B of the second conveying tube 62 of the conveying tube 22. The other end of the conveying member 53 faces the discharge port 63 of the second conveying tube 62.

The conveying member 53 rotates by letting a conveying gear 53A receive a driving force from a driving source (not shown) of the image forming apparatus 1.

(5.2.3 Shutter 65 and Spring 66)

The shutter 65 covers the periphery of the second conveying tube 62. The shutter 65 has a cylindrical shape. The shutter 65 is movable along the second conveying tube 62 between a closing position (see FIG. 4) where the shutter 65 closes the discharge port 63 and an opening position which is disposed close to the ring part 64 relative to the closing position. At the opening position, the shutter 65 releases the discharge port 63 (see FIG. 7). That is, the shutter 65 opens or closes the discharge port 63. The shutter 65 is movable in the attaching/detaching direction.

The spring 66 is disposed between the shutter 65 and the ring part 64. One end of the spring 66 contacts the shutter 65, and the other end of the spring 66 contacts the ring part 64. Thus, the spring 66 constantly presses the shutter 65 toward the closing position.

(5.3 Support Part 84 and Spring 85)

As shown in FIG. 1, the cover 6 includes a support part 84 and a spring 85.

In the state where the process cartridge 3 is attached to the main body 2, the support part 84 extends toward the process cartridge 3 in the attaching/detaching direction. The support part 8 has an end continuing to the cover 6 and the other end disposed to be closer to the process cartridge 3 relative to the one end of the support part 8.

The spring 85 is supported by the other end of the support part 84. In the state where the process cartridge 3 is attached to the main body 2, the spring 85 contacts the development cartridge 8. As a result, the spring 85 presses the development cartridge 8 toward the photosensitive drum 17.

Therefore, in the state where the process cartridge 3 is attached to the main body 2, it is possible to prevent the process cartridge 8 from moving away from the drum cartridge 7 in the attaching/detaching direction. The spring 85 is able to appropriately maintain swinging of the development roller 25 and the photosensitive drum 17.

(6. Attaching and Detaching of Development Cartridge 8 with Respect to Drum Cartridge 7)

Hereafter, attaching and detaching of the development cartridge 8 with respect to the drum cartridge 7 is explained.

In order to attach the development cartridge 8 to the drum cartridge 7, a user pushes the development cartridge 8 to the drum cartridge 7.

Then, one end of the shaft 25A of the development roller 25 is guided by the first development guide 45 of the drum cartridge 7. Further, the other end of the shaft 25A of the development roller 25 is guided by the second development guide 46 of the drum cartridge 7.

Thus, the development cartridge 7 moves to approach the photosensitive drum 17.

Then, as shown in FIG. 7, the second conveying tube 62 of the conveying tube 22 is received by the receiving cylinder 76 of the projecting part 71.

At this time, the shutter 73 of the development cartridge 8 contacts the second conveying tube 62, and the shutter 65 of the drum cartridge 7 contacts the projecting part 71. By further pushing the development cartridge 8, the shutter 73 is disposed at the opening position while moving against the pressing force of the spring 74. Further, the shutter 75 is disposed at the opening position against the pressing force of the spring 66.

In this case, the discharge port 63 of the second conveying tube 62 and the receiving port 77 of the receiving cylinder 76 face with each other. As a result, the discharge port 63 of the second conveying tube 62 communicates with the receiving port 77 of the receiving cylinder 76.

Thus, the attaching of the development cartridge 8 to the drum cartridge 7 is completed.

It should be noted that, in order to detach the development cartridge 8 from the drum cartridge 7, the user operates the development cartridge 8 in a reverse manner with respect to the above described attaching manner.

Then, as shown in FIG. 8, the process cartridge 3, i.e., the drum cartridge 7 to which the development cartridge 8 has been attached, is attached to the main body 2. In order to attach the process cartridge 3 to the main body 2, the user moves the cover 6 to the opening position to release the opening 5.

Then, the user attaches the process cartridge 3 to the main body 2 via the opening 5.

Then, the user moves the cover 6 to the closing position as shown in FIG. 1.

As a result, the image forming apparatus 1 becomes ready for execution of the image forming operation.

In order to detach the process cartridge 3 from the main body 2, the user grasps the handle 58 and operates the process cartridge 3 in a reverse manner with respect to the above described attaching manner of the process cartridge 3.

Figure 9:
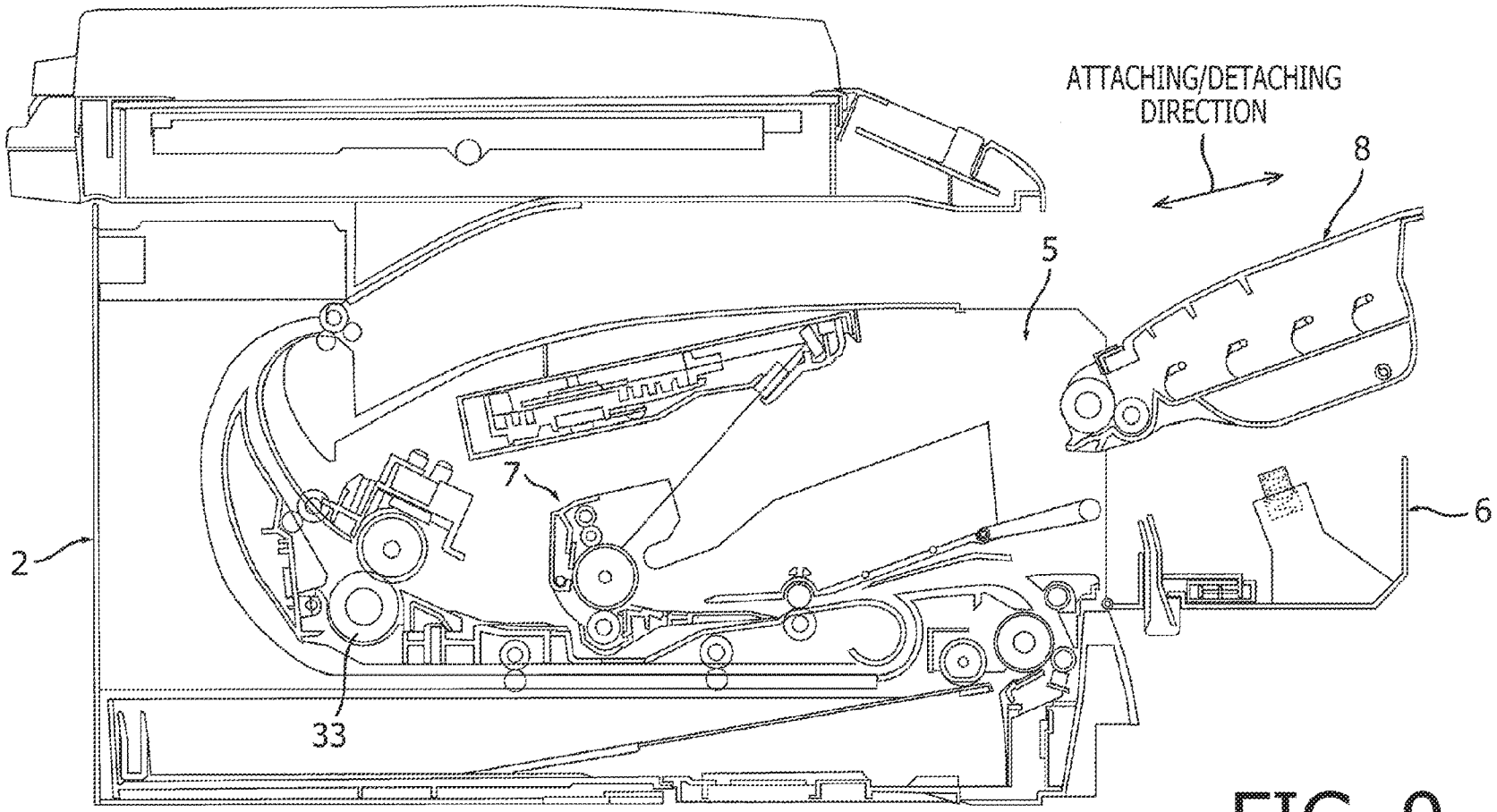
FIG. 9 is an explanatory illustration showing attaching and detaching of the development cartridge with respect to the drum cartridge.

As shown in FIG. 9, even when the process cartridge 3 has been attached to the main body 2, the development cartridge 8 can be attached to or detached from the drum cartridge 7.

(7. Removal of Toner)

There is a case where the toner which has not been transferred to the sheet P during the image forming operation is adhered to the circumferential surface of the photosensitive drum 17.

As shown in FIGS. 6 and 7, during the image forming operation, the toner remaining on the circumferential surface of the photosensitive drum 17 is wiped off by the cleaning member 51 of the cleaner 21 by rotation of the photosensitive drum 17. The toner thus wiped off is then stored in the cleaning frame 50.

The toner stored in the cleaning frame 50 is conveyed from the cleaning frame 50 to the conveying tube 22 by rotation of the conveying member 53. The toner conveyed in the conveying tube 22 is then conveyed toward the waste toner case 29 while passing the first conveying tube 61 and the second conveying tube 62 in this order.

The toner which has been conveyed to the second conveying tube 62 flows into the projecting part 71 via the discharge port 63 of the second conveying tube 62 and the receiving port 77 of the receiving cylinder 76.

Then, the toner which has flowed into the projecting part 71 is conveyed by the auger screw 72 to the body unit 70 and is stored in the body unit 70.

Thus, conveying of the toner is completed.

(8. Advantageous Effects)

(1) As shown in FIGS. 5 and 7, according to the process cartridge 3, the second conveying tube 62 connected to the waste toner case 29 is disposed closer to the second side wall 28B relative to the first part 61C connected to the cleaner 21, and the third part 61E connects the first part 61C with the second part 61D and the second conveying tube 62.

Therefore, the conveying tube 22 is bent to approach the second side wall 28B in the axis direction between the first part 61C and the second part 61D.

As a result, the space to dispose the conveying tube 22 can be decreased, and the process cartridge 3 can be decreased in size.

(2) As shown in FIGS. 3 and 5, according to the process cartridge 3, the second part 61D and the second conveying tube 62 are disposed between the first side wall 28A and the second side wall 28B in the axis direction.

Therefore, the space for disposing the second part 61D and the second conveying tube 62 can be secured between the first side wall 28A and the second side wall 28B in the axis direction, and thereby the size of the process cartridge 3 in the axis direction can be decreased securely.

(3) As shown in FIGS. 3 and 5, according to the process cartridge 3, at least a part of the third part 61E is disposed between the conveying roller 57 and the waste toner case 29 in the direction in which the conveying tube 22 extends. Therefore, the third part 61E and the conveying roller 57 can be disposed effectively.

(4) As shown in FIG. 5, according to the process cartridge 3, the space for disposing the second part 61D and the second conveying tube 62 is secured between the first holding part 57A and the second holding part 57B in the axis direction.

(5) As shown in FIG. 4, according to the process cartridge 3, since the third part 61E is disposed at an upper position with respect to the conveying roller 57, the third part 61E and the conveying roller 57 can be effectively disposed.

(6) As shown in FIGS. 5 and 7, according to the process cartridge 3, the conveying member 53 is formed to extend in a spiral shape. Therefore, even when the conveying tube 22 is bent to approach the second side wall 28B in the axis direction, the conveying member 53 can be disposed in the conveying tube 22 by deforming freely in the conveying tube 22.

Therefore, the toner removed by the cleaner 21 can be securely conveyed to the waste toner case 29 through the conveying tube 22.

(7) As shown in FIG. 5, according to the process cartridge 3, the first part 61C, the second part 61D and the third part 61E are integrally formed as a continuous component. Therefore, the conveying tube 22 can be formed, for example, by blow molding.

(8) As shown in FIGS. 3 and 5, according to the process cartridge 3, the body unit 70 of the waste toner case 29 is disposed between the first side wall 28A and the second side wall 28B in the axis direction. Further, the first part 61C is disposed on the opposite side of the fourth side wall 70B with respect to the third side wall 70A in the axis direction. Therefore, the body unit 70 of the waste toner case 29 is disposed on the opposite side of the first part 61C with respect to the first side wall 28A in the axis direction. As a result, the size of the process cartridge 3 in the axis direction can be decreased more securely.

Since the second part 61D and the second conveying tube 62 are disposed closer to the second side wall 28B relative to the first part 61C, even when the waste toner case 29 is disposed on the opposite side of the first part 61C with respect to the first side wall 28A, the second conveying tube 62 of the conveying tube 22 and the waste toner case 29 can be connected securely.

(9) As shown in FIGS. 4 and 7, according to the process cartridge 3, the development cartridge 8 having the waste toner case 29 can be detachably attachable to the drum cartridge 7. Therefore, the waste toner case 29 and the drum cartridge 7 can be replaced separately. As a result, running cost can be reduced.

Furthermore, by moving the waste tone case 29 in the attaching/detaching direction, the second conveying tube 62 can be inserted into or withdrawn from the receiving cylinder 76.

Therefore, even when the development cartridge 8 having the waste toner case 29 is detachably attachable to the drum cartridge 7, the second part 61D and the second conveying tube 62 can be securely connected to the waste toner case 29.

(10) As shown in FIGS. 4 and 7, according to the process cartridge 3, the shutter 65 is movable in the attaching/detaching direction. Therefore, when the development cartridge 8 having the waste toner case 29 moves in the attaching/detaching direction and the second conveying tube 62 of the conveying tube 22 is inserted into or withdrawn from the waste tone case 29, the shutter 65 is able to open or close the discharge port 63.

(11) As shown in FIGS. 4 and 7, according to the process cartridge 3, the second conveying tube 62 extends in the attaching/detaching direction. Therefore, by letting the development cartridge 8 having the waste toner case 29 move in the attaching/detaching direction, the second conveying tube 62 can be securely inserted into or withdrawn from the receiving cylinder 76 of the waste toner case 29.

(12) As shown in FIG. 7, according to the process cartridge 3, by the first development guide 45 of the drum cartridge 7, the development cartridge 8 can be smoothly attached to or detached from the drum cartridge 7.

(13) As shown in FIG. 5, according to the process cartridge 3, the second part 61D and the second conveying tube 62 are disposed on the opposite side of the first part 61C with respect to the first development guide 45. Therefore, the second part 61D, the second conveying tube 62 and the first development guide 45 are effectively disposed.

(14) As shown in FIGS. 4 and 7, according to the process cartridge 3, the first development guide 45 is disposed at an upper position with respect to the first part 61C. Therefore, the development cartridge 8 can be attached to or detached from the drum cartridge 7 without being obstructed by the first part 61C.

(15) As shown in FIG. 7, according to the process cartridge 3, since the development cartridge 8 moves in the attaching/detaching direction to follow, for example, swinging of the photosensitive drum 17, the contact state between the development roller 25 and the photosensitive drum 17 can be stably secured.

Although in this case the second conveying tube 62 and the receiving cylinder 76 move relative to each other, movement of the development cartridge 8 is not obstructed because the second conveying tube 62 extends in the attaching/detaching direction.

Similarly, since the moving direction of the shutter 65 and the moving direction of the shutter 73 are equal to each other, movement of the development cartridge 8 is not obstructed.

(16) As shown in FIGS. 4 and 7, according to the process cartridge 3, there is a possibility that the toner spills from the discharge port 63. However, the spilled toner is received by the connecting wall 43 and thereby the inside of the image forming apparatus 1 is prevented from becoming dirty.

Second Illustrative Embodiment

Hereafter, a second illustrative embodiment is described with reference to FIGS. 10A and 10B. In the following explanation, to elements which are substantially the same as those of the first illustrative embodiment, the same reference numbers are assigned and explanations thereof will not be repeated for the sake of simplicity.

In the above described first illustrative embodiment, as shown in FIGS. 2A and 2B, the toner storing part 28 and the waste toner storing case 29 are integrally formed.

Figure 10A:
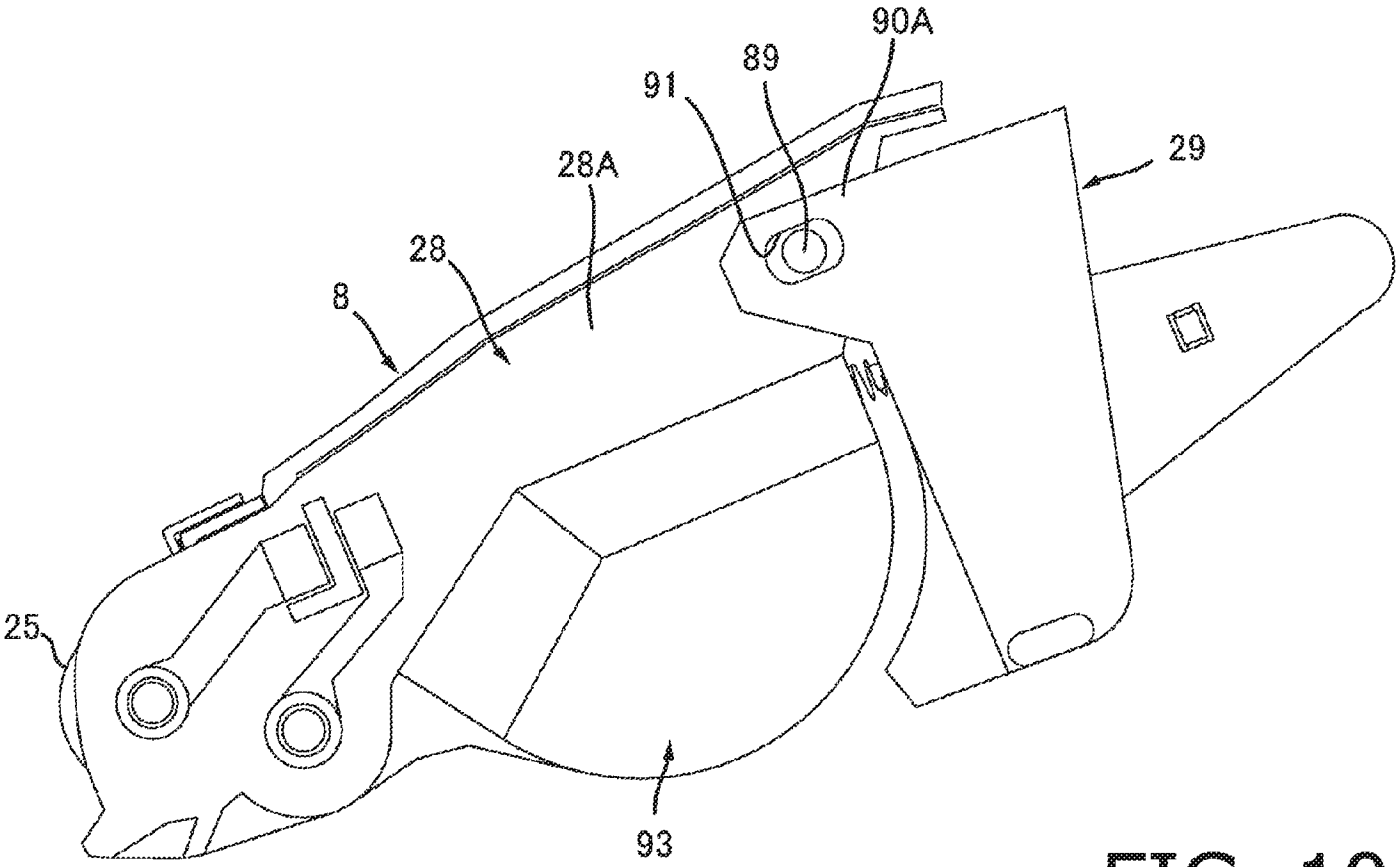
FIG. 10A is a side view of a development cartridge and a waste toner case according to a second illustrative embodiment.
Figure 10B:
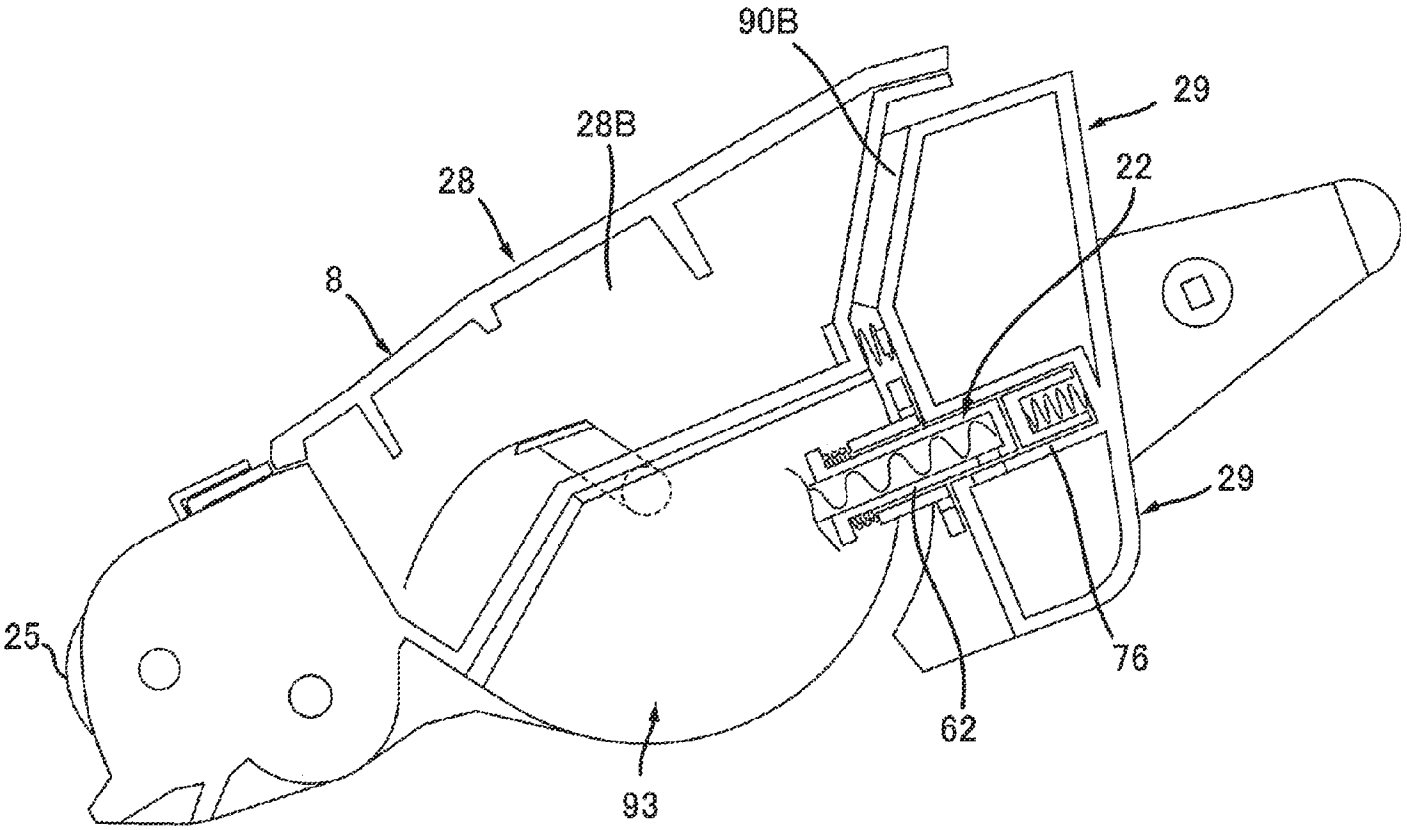
FIG. 10B is a side cross section of the development cartridge and the waste toner case shown in FIG. 10A.

By contrast, according to the second illustrative embodiment, as shown in FIGS. 10A and 10B, the toner storing part 28 and the waste toner case 29 are formed as separate components.

According to the process cartridge 3 of the second illustrative embodiment, the waste toner case 29 is separately provided from the toner storing part 28, and is slidably and rotatably connected to the development cartridge 8.

Specifically, the first side wall 28A of the toner storing part 28 includes a projecting part 89. The projecting part 89 is projected to move away from the second side wall 28B in the axis direction.

As in the case of the first side wall 28A, the second side wall 28B includes the projecting part 89.

In the attaching/detaching direction, the waste toner case 29 is disposed on the opposite side of the development roller 25 with respect to the toner storing part 28. In the attaching/detaching direction, the waste toner case 29 overlaps with the toner storing part 28. The waste toner case 29 includes an arm 90A and an arm 90B.

The arm 90A and the arm 90B are disposed to be spaced with respect to each other in the axis direction.

In the attaching/detaching direction, the arm 90A extends toward the development cartridge 8 from the waste toner case 29. The arm 90A is arranged side by side with the first side wall 28A in the axis direction. The arm 90A has a hole 91.

The hole 91 penetrates through the arm 90A. The hole 91 extends in the attaching/detaching direction.

The arm 90B is disposed on the opposite side of the arm 90A with respect to the development cartridge 8. As in the case of the arm 90A, the arm 90B has a hole 91.

The hole 91 of the arm 90A receives the projecting part 89 of the first side wall 28A, and the hole 91 of the arm 90B receives the projecting part 89 of the second side wall 28B.

As a result, the waste toner case 29 is rotatably connected to the development cartridge 8 with respect to the projecting part 89 as a fulcrum.

As described above, the waste toner case 29 is detachably attachable to the drum cartridge 7 together with the development cartridge 8.

The toner storing part 28 has a recessed part 93.

The recessed part 93 does not overlap with the projecting part 89 in the axis direction. Preferably, the recessed part 93 is disposed at a lower position with respect to the projecting part 89. The recessed part 93 is recessed toward the second side wall 28B from the first side wall 28A.

As shown in FIG. 10B, in the state where the development cartridge 8 and the waste toner case 29 are attached to the drum cartridge 7, a part of the conveying tube 22 is disposed in the recessed part 93.

Specifically, the second conveying tube 62 is disposed in the recessed part 93. The second conveying tube 62 fits into the receiving cylinder 76 of the waste toner case 29.

Thus, the discharge port 63 of the second conveying tube 62 and the receiving port 77 of the receiving cylinder 76 face with each other. As a result, the discharge port 63 of the conveying tube 22 communicates with the receiving port 77 of the receiving cylinder 76.

According to the second illustrative embodiment, the same advantageous effects as those of the first illustrative embodiment can also be achieved.

What is claimed is:

1. A process cartridge, comprising:

a drum cartridge; and a development cartridge attachable to the drum cartridge, the drum cartridge comprising:

a photosensitive drum having a circumferential surface;

a cleaner configured to remove toner from the circumferential surface of the photosensitive drum; and a conveying tube configured to convey the toner removed by the cleaner, and the development cartridge comprising:

a waste toner case configured to store the toner conveyed by the conveying tube;

a development roller extending in an axial direction;

a first side wall supporting one end of the development roller; and a second side wall supporting an other end of the development roller, the conveying tube comprises:

a first part disposed on an opposite side of the second side wall with respect to the first side wall in the axial direction of the development roller, the first part of the conveying tube being connected to the cleaner;

a second part disposed closer to the second side wall relative to the first part of the conveying tube, the second part of the conveying tube being connected to the waste toner case; and a third part connecting the first part of the conveying tube with the second part of the conveying tube, wherein a direction in which the development cartridge is attached to the drum cartridge is parallel to an extending direction in which the second part of the conveying tube extends, wherein the extending direction in which the second part of the conveying tube extends is perpendicular to the axial direction of the development roller, and wherein the waste toner case has a receiving part into which an end portion of the second part of the conveying tube is inserted in the extending direction in which the second part of the conveying tube extends.

2. The process cartridge according to claim 1, wherein the second part of the conveying tube is disposed on an opposite side of the first part of the conveying tube with respect to the first side wall in the axial direction of the development roller.

3. The process cartridge according to claim 1, further comprising a conveying roller disposed between the development roller and the waste toner case in the extending direction in which the second part of the conveying tube extends, the conveying roller being configured to convey a sheet, wherein at least a part of the third part of the conveying tube is disposed between the conveying roller and the waste toner case in the direction in which the conveying tube extends.

4. The process cartridge according to claim 3, further comprising:

a first holding part configured to hold the conveying roller; and a second holding part configured to hold the conveying roller, wherein the second part of the conveying tube is disposed between the first holding part and the second holding part in the axial direction of the development roller.

5. The process cartridge according to claim 3, wherein the third part of the conveying tube is disposed at an upper position with respect to the conveying roller.

6. The process cartridge according to claim 1, further comprising a conveying member configured to extend in a spiral shape and to be rotatable about a spiral axis of the spiral shape, the conveying member being disposed in the conveying tube.

7. The process cartridge according to claim 1, wherein the first part of the conveying tube, the second part of the conveying tube and the third part of the conveying tube are formed integrally and continuously.

8. The process cartridge according to claim 1, wherein the second part of the conveying tube comprises:

a discharge port configured to let toner be discharged therethrough; and a shutter configured to open or close the discharge port, and wherein the shutter is configured to be movable in an attaching and detaching direction of the waste toner case with respect to the drum cartridge.

9. The process cartridge according to claim 1, wherein each of the first part of the conveying tube and the second part of the conveying tube is formed to extend in an attaching and detaching direction of the waste toner case with respect to the drum cartridge.

10. The process cartridge according to claim 1, wherein the development cartridge further comprises:

a toner storing part configured to store toner, and wherein the drum cartridge comprises a guide part configured to guide attaching and detaching of the development cartridge with respect to the drum cartridge.

11. The process cartridge according to claim 10, wherein the second part of the conveying tube is disposed on an opposite side of the first part of the conveying tube with respect to the guide part in the axial direction of the development roller.

12. The process cartridge according to claim 10, wherein the guide part is disposed at an upper position with respect to the first part of the conveying tube.

13. The process cartridge according to claim 1, wherein the conveying tube and the receiving part are movable relative to each other in the extending direction in which the second part of the conveying tube extends.

* * * * *